United States Patent [19]

Houben

[11] 4,199,104

[45] Apr. 22, 1980

[54] PLASMA SPRAYING APPARATUS

[75] Inventor: Johan M. Houben, Lieshout, Netherlands

[73] Assignee: Plasmainvent AG, Switzerland

[21] Appl. No.: 760,942

[22] Filed: Jan. 21, 1977

[30] Foreign Application Priority Data

Jan. 23, 1976 [NL] Netherlands ..... 7600738

[51] Int. Cl.[2] ..... B05B 17/04

[52] U.S. Cl. ..... 239/81; 239/85; 219/76.16

[58] Field of Search ..... 239/81-85, 239/79, 80, 563, 126; 219/76.16, 121 P; 55/458, 459 R

[56] References Cited

U.S. PATENT DOCUMENTS

| | | | |
|---|---|---|---|
| 153,311 | 7/1874 | Bristol | 239/563 X |
| 1,236,805 | 8/1917 | Williams | 55/458 |
| 1,909,252 | 5/1933 | Case | 239/85 X |
| 2,074,818 | 3/1937 | Watson | 55/458 X |
| 3,145,287 | 8/1964 | Siebein et al. | 239/81 X |
| 3,387,110 | 6/1968 | Wendler et al. | 219/121 P |
| 3,463,397 | 8/1969 | Mecklin et al. | 239/126 |
| 3,546,854 | 12/1970 | Muller | 55/458 X |
| 3,573,090 | 3/1971 | Peterson | 239/81 X |
| 3,676,638 | 7/1972 | Stand | 219/121 P |

*Primary Examiner*—John J. Love

*Attorney, Agent, or Firm*—Fitzpatrick, Cella, Harper & Scinto

[57] ABSTRACT

Plasma spraying apparatus is provided with means for selective release of carrier gas for the coating powder prior to the injection of the powder into the plasma stream. The gas release is effected by one or two apertured tube wall portions associated with a closure sleeve slidable on the tube or by a swirl chamber with a lateral gas outlet provided with a filter and a regulating valve.

1 Claim, 6 Drawing Figures

Fig.1
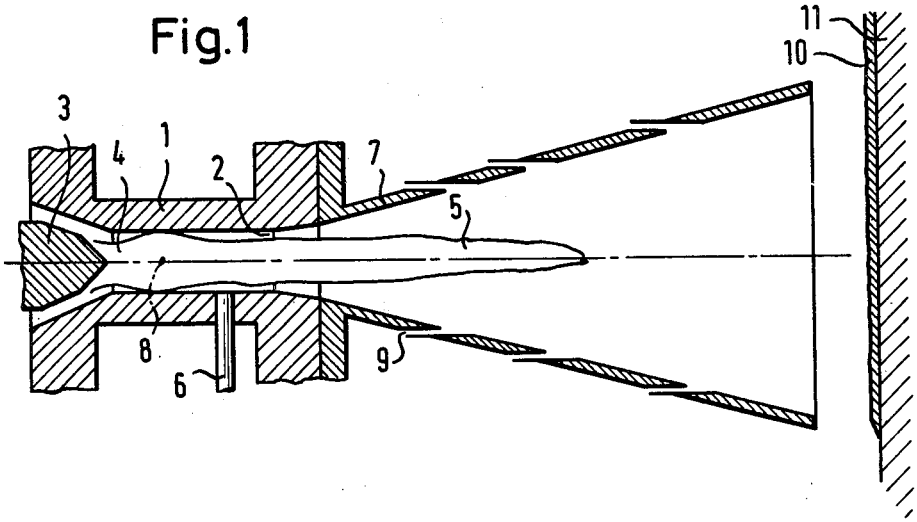
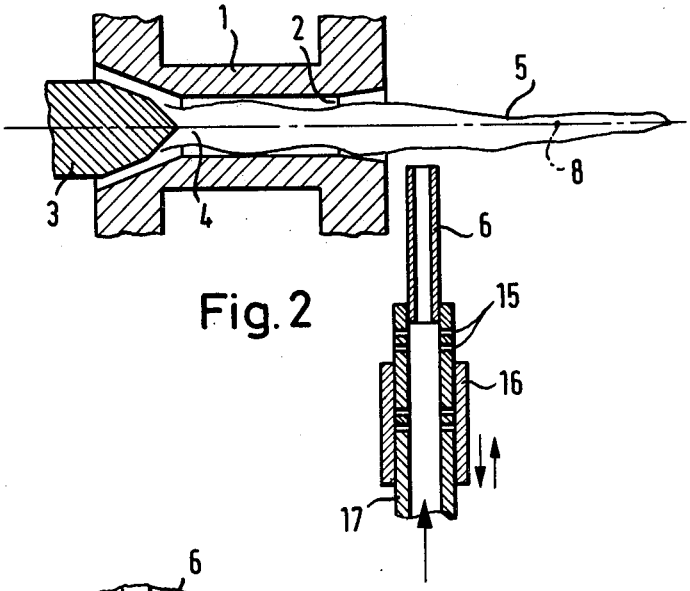
Fig. 2
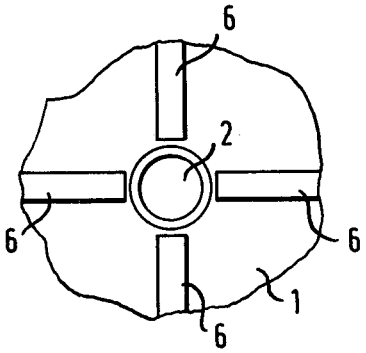
Fig. 3

PLASMA SPRAYING APPARATUS

The invention relates to a plasma spraying apparatus.

Such apparatus may comprise a casing having an outlet aperture and serving as an anode, means for supplying a protective gas, a cathode, means for maintaining an arc discharge between the cathode and the casing, and at least one intake for powder to be sprayed, the powder being introduced in a direction inclined to the stream of plasma. Such an arrangement can be employed for spraying a coating upon a substrate.

In the U.S. Pat. No. 3 573 090 there is described a plasma spraying process for spraying a coating upon a substrate, which although simple and reliable in respect of the construction of the means for supplying the powder to the plasma stream, nevertheless involves the risk that the propellant gas for the coating powder will cause the plasma stream to be deflected from its desired direction, with the result that there will be a nonuniform deposit of the powder upon the substrate. Also it is not possible to introduce the powder sufficiently uniformly through the protective gas centrally into the plasma stream.

It is an object of the present invention to provide plasma spraying applications in which the momentum of the stream of coating powder particles during the latter portion of its path of movement into the plasma stream is controlled in such a manner that the powder particles are uniformly entrained by the plasma stream, the propellant gas for the powder particles being prevented from exerting an influence upon the direction or temperature of the plasma stream.

The present invention accordingly provides a plasma spraying apparatus having in the injection means for the coating powder means for adjustably releasing the propellant gas for the powder.

Such pressure relieving means makes it possible to adjust the amount of gas for injecting the powder particles into the plasma stream to precisely the correct momentum in a simple manner. It becomes possible to avoid conditions under which the propellant gas for the powder deflects the direction taken by the plasma stream with the protective or shielding gas.

The injection means can comprise a plurality of injection tubes around the plasma stream.

According to one embodiment of the invention, the release means comprises a supply tube, the wall of which is perforated, a sliding shutter impermeable to gas being displaceable upon the supply tube to selectively cover the perforations. Advantageously the sliding shutter has the form of a sleeve slidable upon the supply tube. The correct momentum for the powder particles can be obtained simply by displacement of the sleeve.

The perforations in the wall of the supply tube may appropriately have a diameter in the range of 0.1 and 0.5 mm. Alternatively, instead of providing perforations in the supply tube wall, portions of the wall may consist of porous material.

According to a further feature of this embodiment, there are provided in another portion of the supply tube bores which can be selectively covered by a further shutter slidable on the supply tube. The bores in the supply tube can have diameters ranging between about 0.005 and 0.5 mm, and preferably in the region of the one shutter the diameters are between 0.005 and 0.1 mm and in the region of the other shutter, 0.1 to 0.5 mm.

Thus by means of the first-mentioned shutter there can be achieved a fine adjustment of the powder supply, and by means of the second shutter, a coarse adjustment. Moreover, instead of using the bores, it is again possible to provide portions of the supply tube of porous and microporous material—these corresponding to coarse adjustment and fine adjustment.

In accordance with a further embodiment of the invention, the relief means comprises a swirl chamber with an adjustable gas outlet. There may be provided in the gas outlet a filter and a control valve. The filter prevents the escape of powder particles through the gas outlet, and the control valve provides the possibility of precise adjustment for the relief pressure in the swirl chamber and the required release of the propellant gas.

It is furthermore advantageous to provide at that end of the swirl chamber remote from the injection tube a tube through which the powder is supplied to the swirl chamber, this tube being slidable into and out of the chamber. The displacement of this tube into and out of the swirl chamber provides a further means for adjusting the supply of powder.

By way of illustration only, and without limiting effect, embodiments of the invention are described below in detail and represented in the accompanying drawings.

In the drawings:

FIG. 1 is a schematic sectional side view of a plasma spraying apparatus having a powder injection tube extending at right angles to the plasma stream;

FIG. 2 is a like view of a plasma spraying apparatus having a powder injection tube extending at right angles to the plasma stream at a position externally of the outlet orifice for the plasma stream;

FIG. 3 is a schematic end view of a plasma spraying apparatus having four powder injection tubes arranged symmetrically about the plasma stream;

Figure 4:
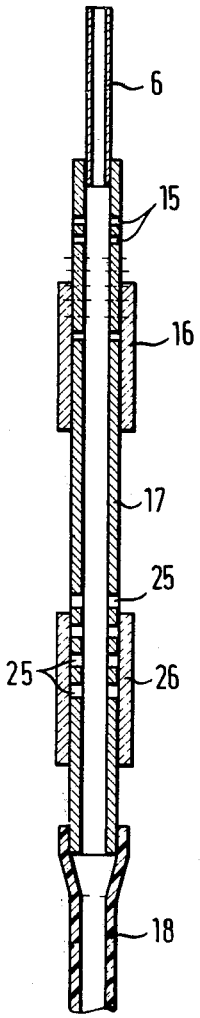
FIG. 4 is a longitudinal sectional view of a further release device for the propellant gas for the powder in a plasma spraying apparatus.

Referring now to the drawings, each of FIGS. 1 and 2 shows a plasma spray apparatus comprising a casing 1 with an outlet orifice 2 for a plasma stream 5. The casing 1 converges in the flow direction to a portion of substantially uniform cross section leading to the outlet aperture 2. Within the casing 1 there are provided supply means for a protective or shielding gas (not shown) and a cathode 3. An arc discharge 4 is maintained between this cathode 3 and the casing 1 which serves as the anode. Also provided is an intake for powder to be sprayed, the intake comprising an injection tube 6 directed at right angles to the direction of flow of the plasma stream 5. The spray powder consists for example of metals, oxide, nitride, boride, silicide, or carbide.

In the apparatus of FIG. 1, an outwardly divergent shielding tube 7 functioning as an extension of the divergent outlet orifice 2 is located around the plasma stream 5 coaxially with the central axis 8 of the casing 1. Ports 9 for a supplementary medium are provided in the wall of this screening tube 7. The ports 9 may be directed axially or tangentially and they may be spaced at various distances from the outlet orifice 2 for the plasma stream 5. By means of this apparatus, a coating 10 is deposited on a substrate 11.

The supply of the supplementary medium through the ports 9 prevents the suction of atmospheric air through the gap between the outer edge of the screening tube 7 and the substrate 11. Together with the protective gas, mostly argon or nitrogen, which is supplied through the casing 1, the supplementary medium should likewise contribute to the chemical and physical conditioning of the available space within the screening tube 7. The supplementary medium may consist wholly or partly of a liquid, for example liquid nitrogen, to effect cooling and screening of the inner wall of the tube 7.

Whereas in the apparatus of FIG. 1 the injection tube 6 for the powder has its outlet at the plasma duct within the casing 1, the apparatus of FIG. 2 includes an injection tube 6 for the powder directed at right angles to the plasma stream 5 at a position downstream of the outlet orifice 2 in the direction of plasma flow. The wall of a supply tube 17 leading to the injection tube 6 is provided with a number of fine perforations 15. A moving shutter 16 in the form of a slidably displaceable sleeve surrounds a portion of the supply tube 17. Because the powder is delivered in a carrier gas it is possible, by diplacement of the shutter 16, to divert a selected quantity of the carrier gas from the supply tube 17 before this gas reaches the outlet of the injection tube 6. By this means the injection momentum of the powder can be regulated independently of the minimum quantity of carrier gas required for conveyance of the powder through the supply tube 17 and injection tube 6. By these means it is possible to convey all of the powder particles through the plasma stream 5 in a comparatively restricted path onto the substrate 11, without the occurrence of any asymmetrical dispersion of the particles, which frequently occurs when employing the conventional types of injection tube directed at an angle to the plasma stream.

The injection tube 6 may however be inclined to the plasma stream 5 at an angle different from 90°. The perforations 15 may have a diameter in the range of about 0.01 to 0.5 mm. Instead of providing the perforations 15, a portion of the supply tube 17 can be made of a material which is porous to gas but not to the powder particles.

FIG. 3 is an end view of a plasma spraying apparatus similar to that in FIG. 2. However, in the apparatus shown in FIG. 3 there are provided, not one injection tube 6, but more than one, for example four, injection tubes 6 spaced about the outlet orifice 2 for the plasma stream 5.

FIG. 4 shows a supply tube 17 in longitudinal section with an injection tube 6 for the powder mounted thereon. This supply tube permits both a coarse adjustment and fine adjustment of the introduction of the powder into the plasma stream 5.

As may be seen from FIG. 4, a hose 18 for the powder is applied to the end of the supply tube 17 remote from the injection tube 6. Over a length of the supply tube 17 adjacent the powder hose 18 there are provided bores 25, which have a diameter in the range of about 0.1 to 0.5 mm. Alternatively, the wall of the supply tube 17 may be of suitably porous material. A sliding shutter 26 having the shape of a sleeve is placed over the bores 25 and by means of this shutter a selected number of the bores 25 may be covered or exposed. The bores 25 and the sliding shutter 26 serve to provide coarse adjustment for control of the supply of powder particles.

Figure 6:
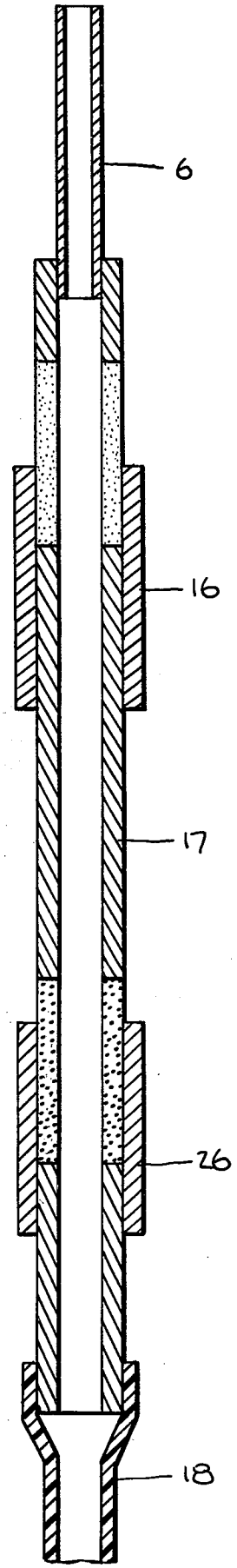
FIG. 6 is a longitudinal sectional view of a modification of the release device shown in FIG. 4.

At that end of the supply tube 17 adjacent the injection tube 6 fine bores 15 are provided as in the apparatus of FIG. 2, these having a diamter in the range of about 0.005 to 0.1 mm. Alternatively, this portion of the wall can be of microporous material as shown in FIG. 6. A displaceable sliding shutter 16 in the form of a sleeve can be moved over the bores 15. The bores 15 and the sliding shutter 16 serve for fine adjustment of the powder supply.

Figure 5:
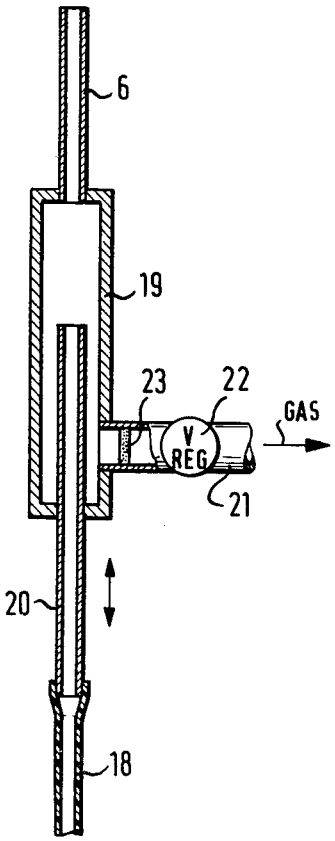
FIG. 5 is a longitudinal sectional view of a further release device for the propellant gas for the powder in a plasma spraying apparatus.

Finally in FIG. 5 there is shown a device for the supply of powder, in which a swirl chamber 19 and a displaceable tube 20 slidably therein are provided between the injection tube 6 and the powder hose 18. The injection tube 6 is mounted at one end of the swirl chamber 19, and the tube 20 is received in the other end of the chamber, the powder hose 18 being fitted to the free end of the tube 20.

At the end of the swirl chamber 19 at which the tube 20 is inserted there is provided a lateral gas outlet 21 with an interposed control valve 22. A filter 23 is provided between the swirl chamber 19 and the control valve 22.

The adjustment of the correct momentum for the powder particles is obtained firstly, by displacement of the slidable tube 20 with respect to the swirl chamber 19, and secondly by increasing or decreasing the opening provided by the control valve 22, so that the gas discharged through the outlet 21 can be suited to the conditions of operation of the associated plasma spraying apparatus.

It will be understood that any one of the powder supply arrangements illustrated in FIGS. 2, 4 and 5 can be incorporated in each of the forms of plasma spraying apparatus shown in FIGS. 1, 2 and 3.

It will also be understood that the foregoing description is illustrative only of the principles of the present invention. Numerous modifications will occur to those skilled in the art without departing from the spirit of the invention, which modifications are accordingly regarded as within its scope.

I claim:

1. A plasma spraying apparatus comprising a casing having an inlet and an outlet orifice;

means for supplying a gas through said inlet to the interior of said casing;

means for producing an electric arc within said casing interior to produce a plasma stream emerging through said outlet orifice;

supply means for a coating powder in a carrier gas having an outlet for introducing said powder into said plasma stream; and release means for selectively and readily adjustably releasing carrier gas from said supply means upstream of said outlet, said release means comprising a chamber in said supply means, an adjustable gas outlet from said chamber, and an inlet tube for delivering powder to said chamber, said inlet tube being slidable lengthwise relatively to the interior of said chamber.

* * * * *